United States Patent [19]

Matsuda et al.

[11] 4,191,369

[45] Mar. 4, 1980

[54] MEANS FOR GUIDING SHEET-LIKE PRINTING PAPER

[75] Inventors: Genji Matsuda; Fumio Hosobuchi, both of Tokyo, Japan

[73] Assignee: Oriental Photo Industrial Co., Ltd., Tokyo, Japan

[21] Appl. No.: 909,923

[22] Filed: May 26, 1978

[30] Foreign Application Priority Data

Jun. 1, 1977 [JP] Japan ..... 52-64426

[51] Int. Cl.[2] ..... B65H 29/58

[52] U.S. Cl. ..... 271/299; 271/186; 271/225; 271/DIG. 9

[58] Field of Search ..... 271/64, 225, 184, 185, 271/186, DIG. 9

[56] References Cited

U.S. PATENT DOCUMENTS

| | | | |
|---|---|---|---|
| 3,206,191 | 9/1965 | Hantscho | 271/64 X |
| 3,304,080 | 2/1967 | Greenblott | 271/64 X |
| 3,856,295 | 12/1974 | Looney | 271/DIG. 9 |
| 3,873,083 | 3/1975 | Fujimoto | 271/64 |
| 4,102,253 | 7/1978 | Gannicott | 271/64 X |

OTHER PUBLICATIONS

Xerox Disclosure Journal, vol. 2, No. 3, pp. 79, 80, May/Jun. 1977, "Paper Path for Automatic Duplex", Ari Bar-on.

*Primary Examiner*—Richard A Schacher
*Attorney, Agent, or Firm*—Blanchard, Flynn, Thiel, Boutell & Tanis

[57] ABSTRACT

Exposed, strip-form printing paper is sequentially cut into separate sheets, the sheets are sorted so that alternate sheets are moved through separate parallel paths wherein they are inverted to place the exposed sides of the sheets upwardly and then they are directed into an automatic developing machine.

7 Claims, 4 Drawing Figures

MEANS FOR GUIDING SHEET-LIKE PRINTING PAPER

BACKGROUND OF THE INVENTION

This invention relates to apparatus for conveying and guiding exposed strip-form printing paper into an automatic developing machine for sheet-like printing paper, which apparatus cuts the exposed strip-form printing paper into sheets and guides the resulting sheets of exposed printing paper into the automatic developing machine after sequentially and alternately sorting the sheets of printing paper.

In order to perform the exposure and developing treatments of a large quantity of printing paper, it is generally suitable to employ a method which comprises exposing an elongated strip or belt of printing paper by a printer, rolling up the exposed printing paper, developing the roll of the printing paper by an automatic developing machine adapted for developing rolls of printing paper and then cutting the developed printing paper by a cutter. However, a satisfactory method for exposing and developing small quantities of strip-form printing paper has not yet been provided, because a large quantity of the printing paper, as much as several tens of centimeters, or sometimes several meters at times, is wasted whenever the printing paper is intermittently treated in accordance with the abovementioned method. As a method of treating strip-form printing paper on a relatively limited scale, depending on the size of the order, a method is known in which the strip-form printing paper, after exposure by a printer, is uct into sheets before it is introduced into the developing machine. Each of the resulting printing paper sheets is then introduced into an automatic developing machine so as thereby to avoid the developing treatment of the unnecessary printing paper.

This method, however, is not suitable for the exposure and developing treatments of a large quantity of strip-form printing paper for the following reason. Namely, since the treating speed of the printer is greater than that of the developing machine, it is essentially necessary to operate the apparatus so that the intervals at which sheets of exposed printing paper are introduced into the automatic developing machine, i.e., the interval of time between the feeding of one sheet of printing paper and the feeding of the next sheet of printing paper, are relatively long. For example, a method of reducing the feeding interval of the sheets of printing paper is known in order to improve the treating capacity. In this case, the printing paper tends to jam inside an automatic developing machine of the type adapted for developing sheets of printing paper and thus causes operating troubles of the machine. For this reason, this method is not suited for developing a large quantity of strip-form printing paper. It is also known to increase the treating speed of the developing machine. However, in this case, the developing machine must be of large size, thereby involving increased installation cost.

It is, therefore, an object of the present invention to provide apparatus for guiding sheets of printing paper, which apparatus makes it possible to perform the exposure and developing treatments starting with strip-form printing paper and to produce developed sheets in a great quantity or in a limited quantity, depending on the size of the order.

The object of the present invention can be accomplished by apparatus which cuts the strip-form printing paper, after it has been exposed by a printer, into sheets before introducing the printing paper into the developing machine, continuously and alternately sorting these printing paper sheets sequentially and guiding them into an automatic developing machine of the type adapted for developing printing paper sheets.

Namely, the apparatus for guiding and conveying the sheets of printing paper, in accordance with the present invention, comprises cutting means for cutting the exposed strip-form printing paper into sheets, sorting means for sorting the resulting sheets of printing paper conveyed along one feed path into at least two separate passages and conveying and guiding the sheets of printing paper along these separate passages, reversing means for reversing each sheet of printing paper so that its exposed surface faces upwardly, and conveyor means for sequentially changing the conveying direction of the sheets of printing paper, whose exposed surface are facing upwardly, along said separate passages and conveying and guiding them into an automatic developing machine for the sheets of printing paper. In the apparatus of the present invention, the sheets of printing paper, cut into sheet form after exposure, may be conveyed either in the sequence of (1) the sorting means, (2) the reversing means and (3) the conveyor means or in the sequence of (1) the reversing means, (2) the sorting means and (3) the conveyor means.

The present invention will be explained in further detail with reference to the accompanying drawings.

BRIEF DESCRIPTION OF THE DRAWINGS

Referring to FIG. 1, the strip-form printing paper 1 is fed from a supply roll thereof, it is sequentially exposed by the printer 2 for a predetermined period and then is fed out. After a predetermined serial number is printed by a stamper 3 onto an area of the strip-form printing paper 1 corresponding to the size of one sheet, the strip-form printing paper is cut into a sheet of predetermined size by cutting means 4. The sheet is sequentially conveyed and guided by conveyor belts 6 mounted on feed rolls 5 and 5' through a feed passage and then it is fed through the sorting means 7, the reversing means 8 and the conveyor means 9 that are more fully explained hereinafter. The sheet is then subjected to a developing treatment in an automatic developing machine 10 adapted for developing sheet-form printing paper.

Figure 1:
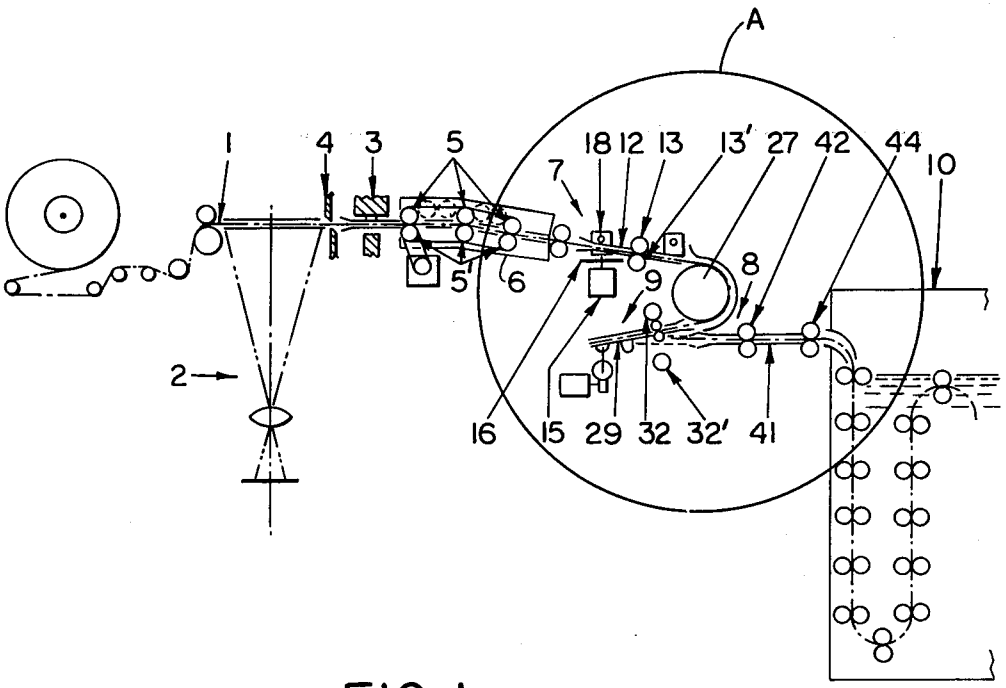
FIG. 1 is a schematic view of the entire exposure and developing apparatus, including the guiding means for guiding the sheets of exposed printing paper, in accordance with the present invention.

It is preferred that the above-mentioned cutting means 4 is connected to a limit switch 11 (FIG. 2) which is arranged in such a manner that unless the switch 11 is actuated, the strip-form printing paper 1 is not cut by the cutting means 4. More particularly, it is preferred that the switch 11 is associated with the cutting means 4 in such a manner that the switch 11 does not actuate the cutting means 4 so long as the switch 11 contacts the upper surface of the sheet-form printing paper during transfer of the printing paper from the conveyor belt 6 to the sorting means 7. The switch 11 actuates the cutting means 4 after completion of the transfer of a sheet of the printing paper from the conveyor belt 6 to the sorting means 7, whereby to cut a following sheet of paper.

Figure 2:
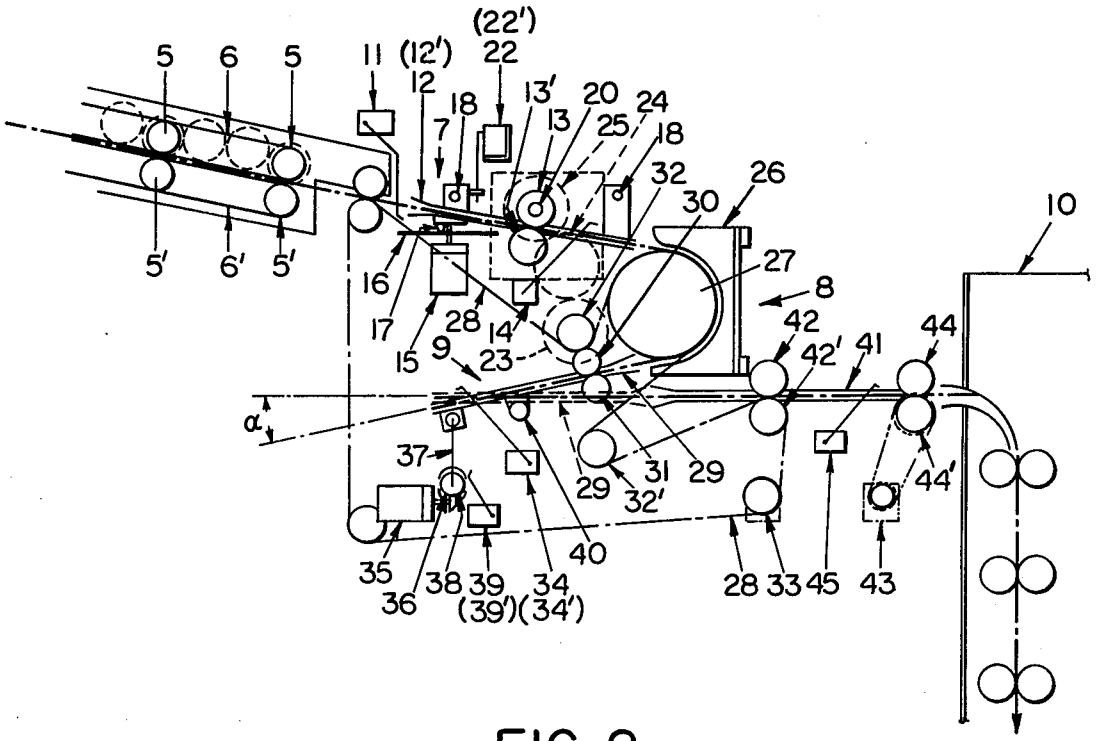
FIG. 2 is an enlarged schematic view of the area within circle A of FIG. 1 and showing the guiding means for the sheets of printing paper in accordance with the present invention, illustrating additional details of the apparatus and omitting the cutting means shown in FIG. 1.
Figure 4:
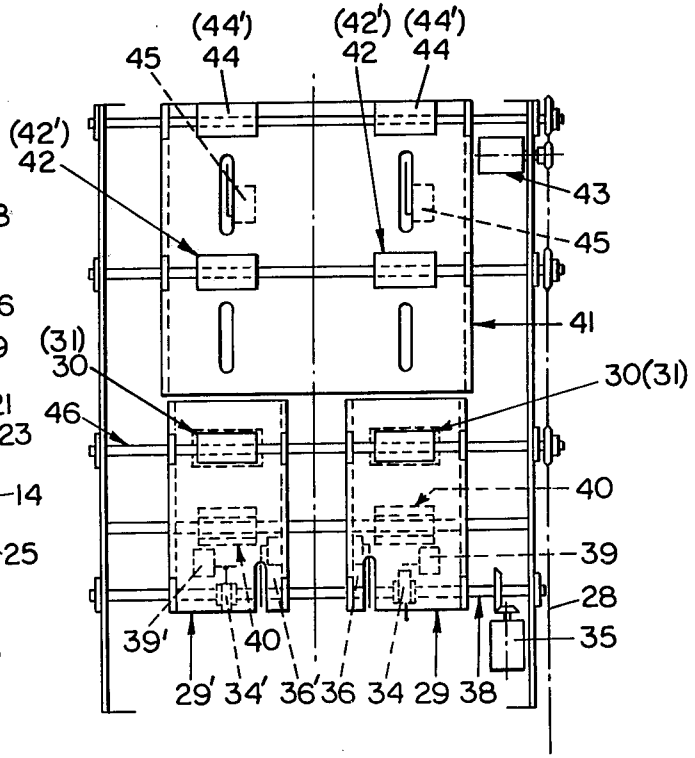
FIG. 4 is a plan view of the turn-back pockets.
Figure 3:
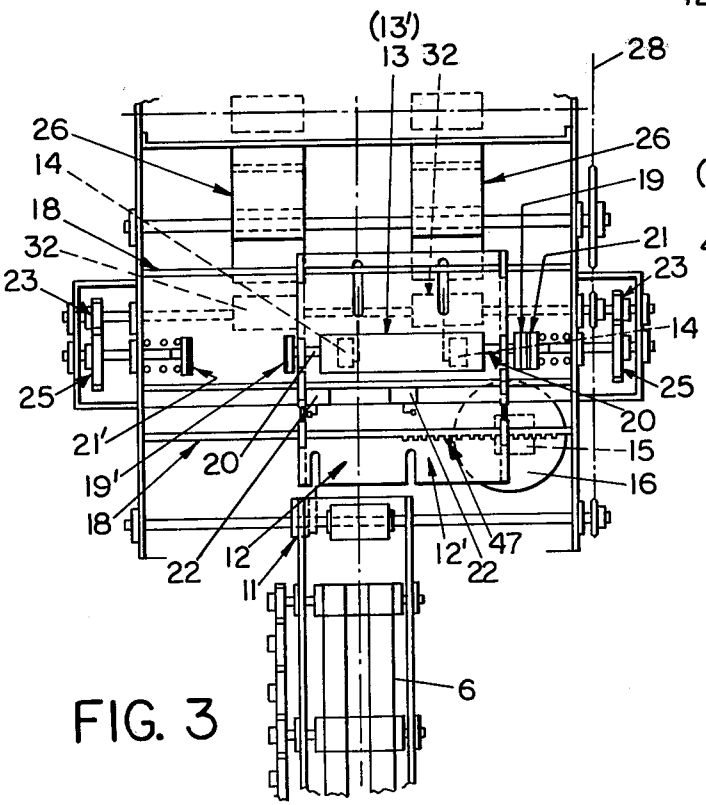
FIG. 3 is a plan view of the sorting means.

FIG. 2 is an enlarged view of the portion encircled by line A in FIG. 1 and illustrates more details of the sorting means 7, the reversing means 8 and the conveyor means 9. As shown in FIGS. 2 and 3, the sheet of printing paper transferred from the conveyor belt 6 is guided by feed rolls into one or the other of the sorting pockets 12 and 12', whichever one of the pockets is in longitudinal alignment with conveyor belt 6. In FIG. 3, the pocket 12 is in longitudinal alignment with conveyor 6. The pockets 12 and 12' are in side-by-side relation and are defined by a relatively thin, flat, hollow casing which is open at its opposite ends to define a transfer inlet and transfer outlet for the printing paper sheet at the opposite ends of the pockets. Means are provided for transferring the printing paper sheet along the passage defined by each pocket thereof. The pockets 12 and 12' can simultaneously be shifted laterally relative to conveyor belt 6, that is, at a right angle to the lengthwise direction of the pockets so that pocket 12 can be moved out of longitudinal alignment with conveyor belt 6 and pocket 12' is simultaneously moved into longitudinal alignment therewith. Means are provided for discharging the printing paper sheets from the separate passages defined by the pockets.

Thus, the means for defining said pockets is capable of reciprocation so as to provide at least two separate passages into which the sheets can move alternately. Accordingly, when the leading edge of the printing paper sheet reaches its forwardmost position in the sorting pocket 12 or 12', the limit switch 14 actuates a motor 15 which functions to laterally shift the pockets whereby to change over the feed of the subsequent printing paper sheet into the other pocket. After sorting is thus completed, the printing paper sheet inside the pocket 12 or 12' is conveyed and guided into the following reversing means 8 as hereinafter described.

More precisely, when the introduction of the printing paper sheet into the pocket 12 is completed in the FIG. 3 position, the switch 11 actuates the cutting means 4 and the feed of the next following sheet of printing paper is initiated. The next following sheet is guided into the pocket 12'. In this manner, the substantially continuously fed printing paper sheets are sequentially and alternately directed into the sorting pockets 12 and 12' and, consequently, into the two separate paths. The present invention is not specifically limited to the use of two sorting pockets, and three or more sorting pockets may also be employed.

Next, the mechanism for sorting and guiding the printing paper sheets into the reversing means 8 is further described with reference to FIG. 3.

The printing paper sheets that are guided from the conveyor belt 6 into the sorting pocket 12 are moved forwardly in the pocket 12 by means of feed roll 13. When the leading edge of the printing paper sheet that is being introduced into the pocket 12 contacts the switch 14, the switch 14 actuates the motor 15 as mentioned above. The motor 15 in turn rotates a disc 16 having a crank 17 secured thereto. One end of the crank 17 is secured to the body defining the pockets 12 and 12' so that when the motor 15 is actuated, the main body defining the pockets 12 and 12' reciprocates along the guide bars 18 to the opposite end of its travel. When this occurs, the driven friction disc 19 is disconnected from the driving friction disc 21. The shaft 20 having the feed roll 13 and the frictional discs 19, 19' secured thereto is thus not supplied with driving force from the driving frictional disc 21 and thus stops rotation during travel of the pockets 12 and 12' between their terminal lateral positions. Accordingly, the printing paper sheet introduced into the sorting pocket 12 becomes stationary. The driven frictional discs 19, 19', the driving frictional disc 21 and a frictional driving disc 21' to be described later each preferably has a large frictional coefficient. It is especially preferred to use natural or synthetic rubber plates, metallic plates having a rough-machined surface and the like.

Stops switches 22 and 22' are provided so as to stop the driving of the above-mentioned motor 15 when the disc 16 has been rotated through an arc of 180 degrees. When the disc 16 has been rotated by 180°, for example, the stop switch 22 stops the driving of the motor 15. At the same time, the frictional disc 19' is again connected to the driving frictional disc 21' so that the shaft 20 starts rotating again and the printing paper sheet that has been at rest inside the sorting pocket 12 is transferred and guided into the reversing means 8 by the feed rolls 13 and 13'. At this time or thereafter, the subsequent printing paper sheet is introduced into the sorting pocket 12'. In the same way as mentioned above, the contact of the switch 14 with the leading edge of this subsequent printing paper sheet again actuates the motor 15 which in turn causes the main body defining pockets 12 and 12' to move along the guide bars 18 in the opposite direction to the above (in this case, the subsequently fed printing paper sheet is at rest inside the sorting pocket 12').

Simultaneously with the stopping of the motor 15 due to the operation of the stop switch 22 after rotation of the disc 16 through 180°, that is, stopping the travel of the main body defining pockets 12 and 12', the frictional disc 19 is reconnected with the driving frictional disc 21, and the shaft 20 is rotated. In this way, printing paper sheets are alternately guided into the pockets 12 and 12' and are sequentially transferred therefrom and guided to the reversing means 8 in two laterally offset paths.

The above-mentioned driving frictional discs 21 and 21' are driven in the following manner. A drive roll 32, to be later described, is driven and rotated as shown in FIG. 2, a gear 23 (indicated by dash line) secured to the same shaft (not shown) also is rotated, and thereby gears 24 and 25 are driven. When the gears 25 are driven, the driving frictional discs 21 and 21' are thus driven and rotated.

As shown in FIG. 2, the reversing means 8 comprises a pair of guide plates 26, one for each of the pockets 12 and 12'. Each of the guide plates 26 is longitudinally aligned with its associated pocket when same has been shifted laterally from alignment with the conveyor belt 6. Reversing drums 27 are associated with the guide plates 26 and are mounted on a shaft which is rotated by a roller chain 28. The printing paper sheets guided from the sorting pockets 12 or 12' to the reversing means 8 are sequentially guided along the reversing drums 27 and the guide plates 26, whereby to invert the sheets so that the exposed sides thereof face upwardly. The sheets then move to turn-back pocket 29 or 29' and then to a synchronizing pocket 41 of the conveyor means 9 which will be described in the following paragraph.

The conveyor means 9 has means for sequentially changing the feed direction of the printing paper sheets fed along the two above-mentioned paths with the exposed surfaces thereof facing upwardly. It is capable of guiding the printing paper sheets into the automatic developing machine 10. More definitely, the conveyor means 9 comprises turn-back pocket devices 29 and 29' and the synchronizing pocket 41 for guiding the printing paper sheets into the automatic developing machine 10 as illustrated in FIGS. 1 and 2. The printing paper sheets guided from the reversing means 8 to the turn-back pocket 29 is introduced into the pocket 29 by the follower rolls 30 and 31 secured to shafts 46. The follower roll 30 is rotated by means of a drive-press roll 32 and roll 31 is rotated by roll 30. The roller chain 28 is mounted onto the drive-press roll 32 to drive the same and is actuated by a driving motor 33.

The printing paper sheet that is being introduced into the turn-back pocket 29 by the follower rolls 30 and 31 is guided through the pocket 29 until its leading edge touches the limit switch 34. When the switch 34 is actuated, an oscillation motor 35 is driven which in turn rotates a cam plate 36 secured thereto and a shaft 38 having a connecting rod 37. When this shaft 38 rotates through an arc of 180 degrees, a stop switch 39 is operated so as to stop the driving of this oscillation motor 35.

In this instance, due to the rotation of the cam plate 36 through an arc of 180 degrees, the turn-back pocket 29 is moved, about the pivot point 40, from the position at which it is inclined at an angle $\alpha$ with respect to the horizontal to a horizontal position. The follower roll 30 is thereby disengaged from the drive-press roll 32, thus stopping the rotation of the follower rolls 30 and 31. Consequently, the sheet-like printing paper introduced into the turn-back pocket 29 becomes at rest in that position. After the above-mentioned cam plate 36 rotates through an arc of 180 degrees, the follower roll 31 engages with the drive-press roll 32' that is rotating in the reverse circumferential direction. Since the drive is transmitted in this manner, the printing paper sheet at rest inside the turn-back pocket 29 is caused to change its feed direction by the follower rolls 30 and 31 and then it is guided into the subsequent synchronizing pocket 41. The driving of this drive-press roll 32' is transmitted from the roller chain 28.

On the other hand, the other turn-back pocket 29' now is inclined at an angle $\alpha$ from the horizontal state, with the pivot point 40 being its center, due to the rotation of the above-mentioned cam plate 36 through an arc of 180 degrees. In this instance, the driving of the drive-press roll 32 is transmitted to the follower rolls 30' and 31' secured to the turn-back pocket 29' and they are thus brought into the waiting condition for the subsequent printing paper sheet transferred from the reversing means 8. The printing paper sheet is introduced into the turn-back pocket 29' until the leading edge thereof touches the limit switch 34', and due to the actuation of the switch 34', the oscillating motor 35 is again actuated, thereby returning again the turn-back pocket 29' to the horizontal state. The subsequent printing paper sheet that has been at rest is caused to change its feed direction by the follower rolls 30' and 31' and then sequentially introduced into the synchronizing pocket 41. Thus, the sheets that respectively alternately entered the pockets 12 and 12', are moved through parallel paths, they alternately enter the turn-back pockets 29, they alternately enter the synchronizing pocket 41 and they alternately enter the developing machine, in parallel relationship.

In FIG. 2, the sheet-like printing paper guided into the synchronizing pocket 41 is introduced thereinto by feed rolls 42 and 42'. These feed rolls 42 and 42' are actuated by the roller chain 28 that drives the roll 42'.

Further in FIG. 2, the printing paper sheet introduced into the synchronizing pocket 41 is guided into the automatic developing machine 10 for the printing paper sheet by rolls 44 and 44' driven by a motor 43 which is independently actuated at a low speed. If the printing paper sheet does not properly move through the guiding means for the printing paper sheets in accordance with the present invention and it is not discharged even after passage of a predetermined time period from the time of operation of the aforementioned switch 11, it is preferred to provide a switch 45 to actuate an alarm by a time-setting timer and to stop the operation of the guiding means of the present invention.

As the automatic developing machine for the printing paper sheet, those conventionally used in the art may be used in the present invention as exemplified, for example, by the photographic developing machines disclosed in Japanese Patent Publication No. 4111/1967, U.S. Pat. No. 3,405,626 U.S. Pat. No. 3,512,468 and the like. However, it is especially suitable to use such a photographic developing machine which incorporates therein a device providing two feed passages for two printing papers such as a feed roll and a feed belt.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. Apparatus for conveying and guiding exposed strip-form photographic printing paper into an automatic photographic developing machine, said strip-form photographic printing paper having a downwardly facing exposed surface, comprising:

means for cutting the exposed strip-form photographic printing paper into sheets;

sorting means and first conveying means for conveying said sheets in single file along a first path to said sorting means, said sorting means comprising reciprocable means for receiving sheets from said first conveying means, means mounting said reciprocable means for reciprocable movement back and forth in a direction extending at a right angle to said first path, said reciprocable means being movable between at least two transfer positions which are laterally offset from said first path and from each other whereby successive sheets are individually transported to the respective transfer positions;

separate substantially horizontal and substantially parallel passageways extending from said transfer positions and second conveying means for separately conveying said sheets along said passageways;

means for inverting said sheets so that the exposed surfaces thereof face upwardly; and third conveying means for sequentially changing the feed direction of said individual sheets that are conveyed from said passageways by said second conveying means and then conveying said sheets into said automatic developing machine.

2. Apparatus as defined in claim 1 including means for guiding the sheet-like printing paper sorted into said at least two passages into an automatic developing machine in the sequence of their exposure.

3. Apparatus as claimed in claim 1 wherein said reciprocable means is a reciprocable carriage having at least two sheet-receiving pockets positioned in side-by-side relation and respectively adapted for receiving individual successively presented sheets, means for reciprocating said carriage in timed relation to the entry of a sheet into each of said pockets so that said carriage is reciprocated after a sheet has entered one of its pockets whereby to move said one pocket to one of said transfer positions and to position another pocket for receiving the next following sheet.

4. Apparatus as claimed in claim 3 in which said second conveying means comprises a rotatable feed roll mounted on said carriage for reciprocation therewith and overlying said pockets for conveying sheets present therein; and drive means for rotating said feed roll when said carriage is located at the respective transfer positions.

5. Apparatus as claimed in claim 3 or claim 4 including first limit switch means positioned for actuation when a sheet is fed into one of said pockets and motor means responsive to actuation of said limit switch means for reciprocating said carriage to another transfer position thereof.

6. Apparatus as claimed in claim 5 including second limit switch means positioned for actuation when a sheet is fed into one of said pockets and means for operating said cutting means in response to actuation of said second limit switch means.

7. Apparatus for conveying and guiding exposed strip-form photographic printing paper into an automatic photographic developing machine, comprising:

means for cutting the exposed strip-form printing paper into sheets;

means for conveying said sheets in single file to a sorting stage;

a reciprocable carriage located at said sorting stage and movable in a direction perpendicular to the direction in which said sheets enter said sorting stage, said carriage having at least two sheet-receiving pockets positioned in side-by-side relation and adapted for receiving successively presented sheets;

means for reciprocating said carriage in timed relation to the entry of sheets into said pockets so that said carriage is reciprocated after a sheet has entered one of its pockets whereby to move said one pocket to a transfer position and to position another pocket for receiving the next following sheet;

guide means extending from the transfer positions for each of the pockets for guiding the sheets through separate parallel paths, one path for each pocket;

roller means for receiving sheets from said guide means and moving said sheets through an arc of about 180° whereby to invert the sheets while moving said sheets through said separate paths;

a plurality of turn-back pockets positioned in side-by-side relation and corresponding in number to the number of said sheet-receiving pockets and said paths and adapted for receiving said sheets one at a time;

means supporting said turn-back pockets for pivotal movement between an inclined position in which said turn-back pockets receive a sheet from said roller means and a horizontal feed position and means for moving said turn-back pockets between said positions in alternating relation;

synchronizing pocket means and means for feeding said sheets, one at a time, from said turn-back pockets into said synchronizing pocket means when said turn-back pockets are in said horizontal feed position;

means for conveying said sheets through said synchronizing pocket means; and a photographic developing machine connected for receiving sheets from said synchronizing pocket means whereby said sheets move in parallel paths from the time they leave said sheet-receiving pockets until they enter said developing machine.

* * * * *